US005748097A

United States Patent [19]

Collins

[11] Patent Number: 5,748,097

[45] Date of Patent: May 5, 1998

[54] METHOD AND APPARATUS FOR STORING THE BOOM OF A WORK VEHICLE

[75] Inventor: David L. Collins, Burlington, Iowa

[73] Assignee: Case Corporation, Racine, Wis.

[21] Appl. No.: 808,312

[22] Filed: Feb. 28, 1997

[51] Int. Cl.[6] ..... G08B 21/00

[52] U.S. Cl. ..... 340/686; 340/685; 414/699; 414/694; 364/424.07

[58] Field of Search ..... 340/686, 685; 37/348; 414/673, 699, 694; 172/812; 364/424.07, 463

[56] References Cited

U.S. PATENT DOCUMENTS

| | | | |
|---|---|---|---|
| 3,376,984 | 4/1968 | Long et al. | 414/694 |
| 4,074,821 | 2/1978 | Long | 414/694 |
| 4,844,685 | 7/1989 | Sagaser | 414/700 |
| 5,000,650 | 3/1991 | Brewer et al. | 414/699 |
| 5,065,326 | 11/1991 | Sahm | 364/424.07 |
| 5,493,798 | 2/1996 | Rocke et al. | 37/348 |
| 5,629,849 | 5/1997 | Ahn | 364/424.07 |

OTHER PUBLICATIONS

Case Corporation brochure "Loader / Backhoes, 580L, 580 Super L, 590 Super L", 1994.

*Primary Examiner*—Jeffery Hofsass
*Assistant Examiner*—Benjamin C. Lee
*Attorney, Agent, or Firm*—Foley & Lardner

[57] ABSTRACT

A method and apparatus is disclosed for storing a boom pivotally mounted to a vehicle. The apparatus includes a boom actuator to actuate the boom, a boom sensor to provide a boom signal representative of the position of the boom actuator with respect to a stable reference point and an actuator control assembly responsive to a control signal to manipulate the position of the boom by retracting or extending the boom cylinder. The apparatus also includes a controller responsive to the boom signal and to provide the control signal to the actuator control assembly so the boom is automatically driven from an initial position extended at least partially away from the vehicle to a transport position in a relatively closer proximity to the vehicle by retracting the boom cylinder to drive the boom from the initial position to a transition position and then extending the boom cylinder to drive the boom from the transition position into the transport position. The method includes the steps of detecting a signal indicative of a position of the boom, determining from the signal whether the boom is positioned within a start range, retracting the hydraulic cylinder to bring the boom toward the base of the work vehicle, determining from the signal whether the boom has reached an over-center position, and extending the hydraulic cylinder to bring the boom toward the base of the work vehicle when the boom has reached the over-center position.

20 Claims, 8 Drawing Sheets

METHOD AND APPARATUS FOR STORING THE BOOM OF A WORK VEHICLE

FIELD OF THE INVENTION

The present invention relates to a method and apparatus for storing a boom of a work vehicle. In particular, the present invention relates to a method and apparatus for storing a boom extendable from a work vehicle in a compact over-center position that facilitates transport of the work vehicle.

BACKGROUND OF THE INVENTION

In the design of work vehicles such as tractors, and loader-backhoes (or other such excavation or construction vehicles), it is well-known to provide a manipulable implement or tool (such as a backhoe assembly) extending or extendable from the base of the vehicle. According to a common arrangement, the implement includes a rotatable and articulable boom (or like structure), typically actuated by one or more hydraulic cylinders within a hydraulic system. Work vehicles of this type (and the related structures and systems) are disclosed, for example, in U.S. Pat. No. 3,376,984 titled "BACKHOE" issued to E. B. Long et al., incorporated by reference herein, and U.S. Pat. No. 4,074,821 titled "OVERCENTER BACKHOE" issued to E. B. Long, incorporated by reference herein (showing a loader-backhoe having a rear-mounted boom). In such work vehicles, the boom (or like implement) is manipulated by the operator through a series of controls providing for coordinated actuation of the corresponding hydraulic cylinders in an appropriate pattern to perform useful work (such as excavation).

In a typical work vehicle such as a loader-backhoe, as the boom is rotated and articulated to certain positions, the profile and center of gravity of the work vehicle may change, which may affect the overall maneuverability and balance of the work vehicle during transport. Moreover, as the boom is rotated and articulated, variations in the static and dynamic (e.g. inertial) properties of the work vehicle may result, which may affect the transportability of the work vehicle. While the static and dynamic effects experienced during articulation of the boom may vary according to the particular design of the work vehicle, for most work vehicles it is desirable to provide for the storing of the boom in a compact orientation that readily facilitates transport. For example, U.S. Pat. No. 4,074,821 shows a loader-backhoe wherein the rear-mounted boom (brought in along with my other articulable members mounted thereto from an extended position) may advantageously be stored in a compact forwardly-inclined "over-center" relationship for transport.

However, in such known arrangements providing for the over-center storing of the boom, the storing process is controlled manually by the operator of the work vehicle. According to the known arrangements, the operator must first raise the boom toward the base of the work vehicle by retracting the corresponding hydraulic cylinder for the boom to a point at which it reaches a substantially vertical center transition position, then continue to move the boom over the center transition point and toward the base of the work vehicle by extending the boom cylinder. Because of the transitional nature of the over-center position (at which further retracting of the boom cylinder will not bring the boom any closer to the base and extension of the boom cylinder must be effected to further bring the boom toward the base), coordinated control is necessary to complete the storing process. However, when the storing process is under manual control, there is a possibility of stalling (or losing momentum) at the center transition point. In any event, it is evident that the manual over-center storing of the boom may require a relatively high degree of coordination, skill and care by the operator, and may present difficulties for certain operators or under certain circumstances.

Accordingly, it would be advantageous to develop a system for automating the over-center storing process for the boom of a backhoe assembly in a work vehicle such as a loader-backhoe. It would also be advantageous to have a apparatus configured to automate the storing of the boom in an over-center orientation while also stowing related segments of the backhoe assembly such as a dipper and a bucket. It would further be advantageous to have a method of operating the apparatus to provide for automated storing of the boom in a compact over-center position that facilitates the transport of the work vehicle.

SUMMARY OF THE INVENTION

The present invention relates to an apparatus for storing a boom pivotally mounted to a vehicle, including a boom actuator adapted to actuate the boom, a boom sensor configured to provide a boom signal representative of the position of the boom actuator with respect to a stable reference point of the vehicle, and an actuator control assembly responsive to a control signal and adapted to manipulate the position of the boom by retracting or extending the boom cylinder. The apparatus also includes a controller responsive to the boom signal and configured to provide the control signal to the actuator control assembly so the boom is automatically driven from an initial position extended at least partially away from the vehicle to a transport position in a relatively closer proximity to the vehicle by retracting the boom cylinder to drive the boom from the initial position to a transition position and then extending the boom cylinder to drive the boom from the transition position into the transport position.

The present invention also relates to a method of storing a boom activated by a hydraulic cylinder in an over-center position with respect to a base of a work vehicle, comprising the steps of detecting a boom signal indicative of a position of the boom, determining from the boom signal whether the boom is positioned within a start range, retracting the hydraulic cylinder to bring the boom toward the base of the work vehicle, determining from the boom signal whether the boom has reached the over-center position, and extending the hydraulic cylinder to bring the boom toward the base of the work vehicle when the boom has reached the over-center position.

DETAILED DESCRIPTION OF THE PREFERRED EMBODIMENTS

Figure 1:
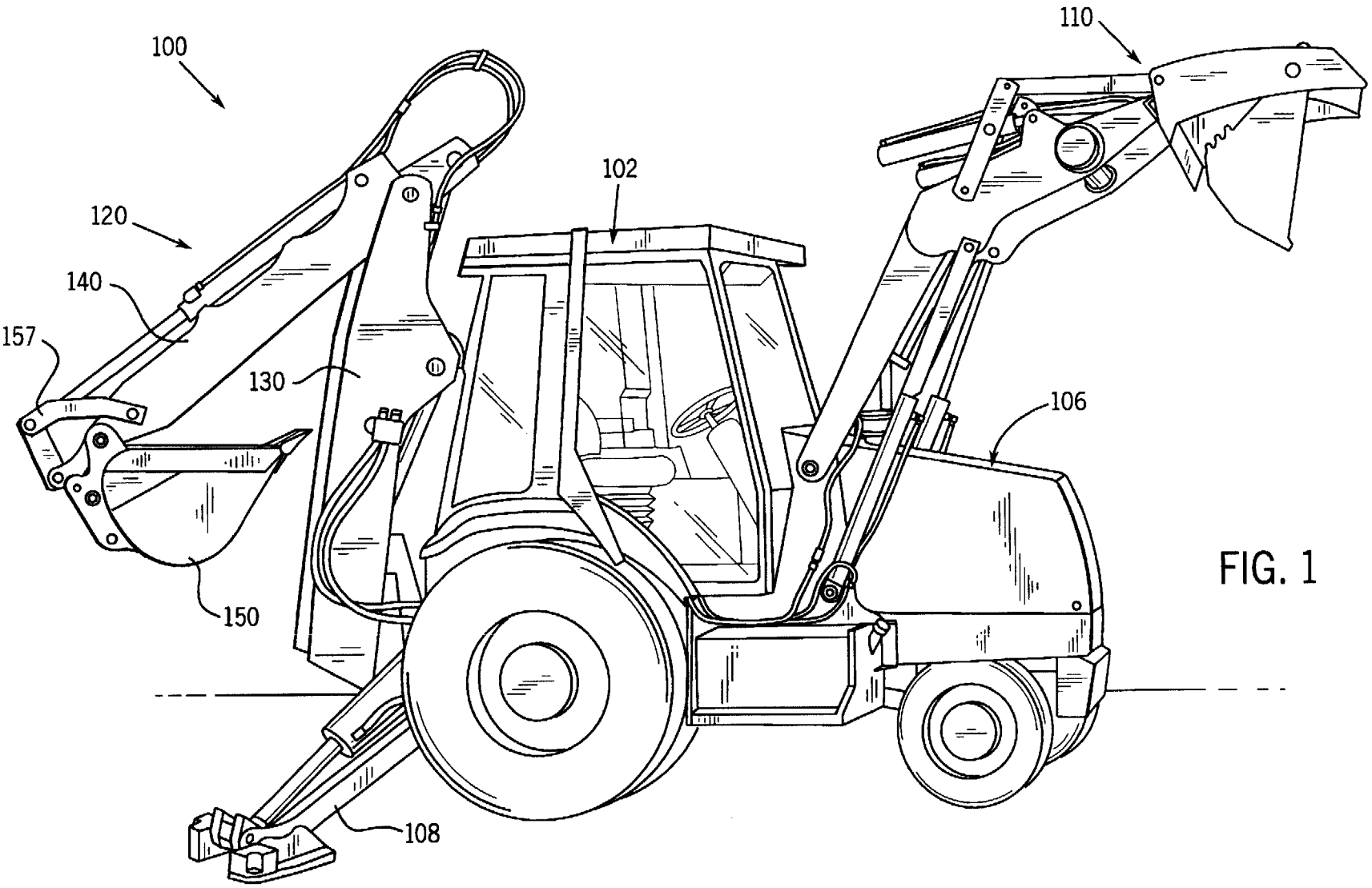
FIG. 1 is a perspective view of a work vehicle shown as a loader-backhoe.

Referring to FIG. 1, a work vehicle (e.g. a conventional loader type of backhoe) is shown, representative of work vehicles such as the Case Corp. 580L, 580 Super L and 590 Super L Loader/Backhoes. Loader-backhoe 100 has a cab 102 (wherein an operator is seated and is provided with a variety of instruments and operator controls) mounted on a base 104 and chassis having four wheels. Also mounted on base 104 is an engine or power plant which powers various drive train and hydraulic system elements.

As shown in FIG. 1, loader-backhoe 100 includes a loader assembly 110 which is mounted at the front end of the vehicle in the proximity of an enclosed compartment 106 (housing the power plant or engine) and a backhoe assembly 120 which is mounted at the rear end of the vehicle. Stabilizing arms 108 (one is shown) are extendable from the side of loader-backhoe 100 adjacent each of the rear wheels and may provide enhanced support and stability as excavation or like work is performed with the backhoe assembly.

The vehicle is provided with a hydraulic system coupled to the engine for providing actuating force to work implements, such as the loader assembly and the backhoe assembly. According to an exemplary embodiment, the hydraulic system is configured to direct hydraulic fluid under pressure developed by a hydraulic pump 166 through lines and tubes (partially shown in FIG. 1 as flexible hoses and shown schematically as lines in FIG. 2A) to linear actuators (shown in FIGS. 2A through 2D as double-acting hydraulic cylinders 124, 132, 142 and 152). The hydraulic system includes a series of solenoid-operated flow control valve assemblies (shown schematically as valves 134, 144 and 154 in FIG. 2A) to control the actuation of the hydraulic cylinders. In a work vehicle employing an embodiment of the present invention, the loader assembly and the backhoe assembly would typically be actuated by double-acting hydraulic cylinders, which may be controlled by the operator at controls within the cab, according to any of a number of arrangements known to those of ordinary skill in the art. An exemplary arrangement of a hydraulic system is shown in U.S. Pat. No. 5,000,650 titled "AUTOMATIC RETURN TO TRAVEL" issued to W. B. Brewer et al., incorporated by reference herein.

Referring to FIGS. 2A through 2D, backhoe assembly 120 is shown broken away in isolation of the work vehicle. As is evident, backhoe assembly 120 is pivotally mounted to the base of the vehicle at a swing tower (through a pin and clevis arrangement) providing for selective rotation of backhoe assembly 120 (in a generally horizontal plane) with respect to the base of the work vehicle about a generally vertical pivotal axis. Pivotal rotation of backhoe assembly 120 about the axis is achieved through a pair of actuating hydraulic swing cylinders.

Backhoe assembly 120 includes three manipulable segments which may be arranged and controlled to operate cooperatively, according to any preferred embodiment, as in a conventional arrangement such as that implemented in the Case Corp. 580L, 580 Super L and 590 Super L Loader/Backhoes (and described and shown in various technical and operating manuals and related literature incorporated by reference herein). These segments include a boom 130, a dipper 140 and a bucket 150, each pivotally coupled in an arrangement to allow selective rotation of one segment with respect to another (or with respect to the base of the vehicle) about a generally horizontal pivotal axis. Through coordinated articulation of each of these segments by the operator, backhoe assembly 120 can be productively employed in such tasks as excavation.

A lower end of boom 130 is pivotally coupled at pivot point for rotation about an axis to swing tower 122; an upper end of boom 130 is pivotally coupled at a pivot point to an upper end of dipper 140 for rotation about an axis. Bucket 150 is pivotally coupled through a linkage 157 having a pivot point to a lower end of dipper 140 for rotation about an axis. As shown, boom 130 is actuated by hydraulic cylinder 132; dipper 140 is actuated by a hydraulic cylinder 142; and bucket 150 is actuated by a hydraulic cylinder 152. Each hydraulic cylinder has a sleeve and an internal driving rod which extends or retracts within the sleeve depending upon the hydraulic flow to the hydraulic cylinder. Each hydraulic cylinder 132, 142 and 152 is coupled through its corresponding hydraulic line to a corresponding hydraulic control valve 134, 144 and 154 (shown schematically in FIG. 2*a*) to a hydraulic system. Hydraulic system 160 includes a pump 166 (typically mechanically coupled to and powered by the engine of the vehicle) configured to develop hydraulic pressure and a hydraulic fluid reservoir 162.

Figure 2A:
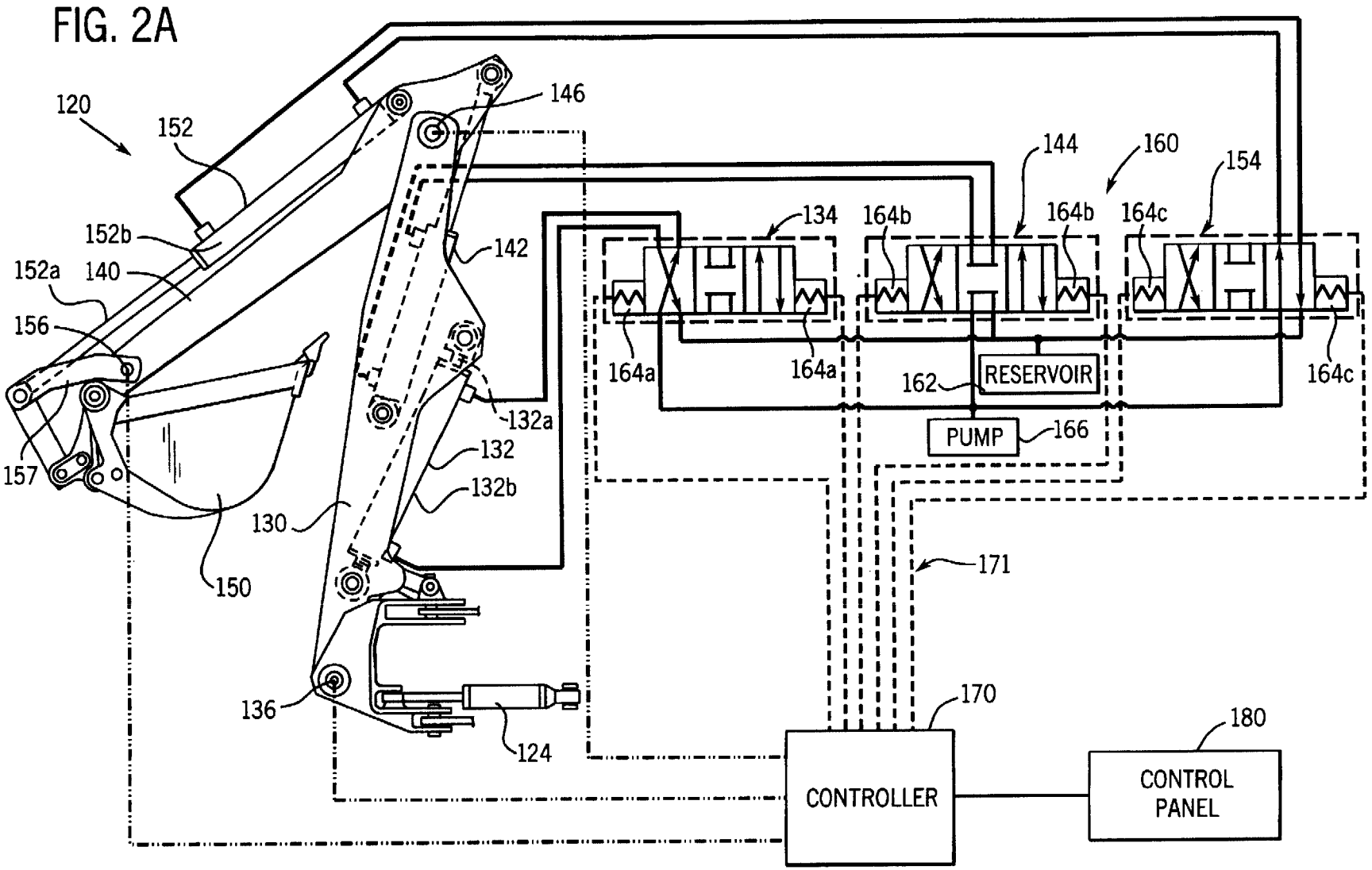
FIG. 2A is a schematic representation of a control system for a backhoe assembly of the loader-backhoe according to a preferred embodiment of the present invention also showing in a side view the backhoe assembly (broken away from the loader-backhoe) wherein a boom of the backhoe assembly is oriented in a stored position.
Figure 2B:
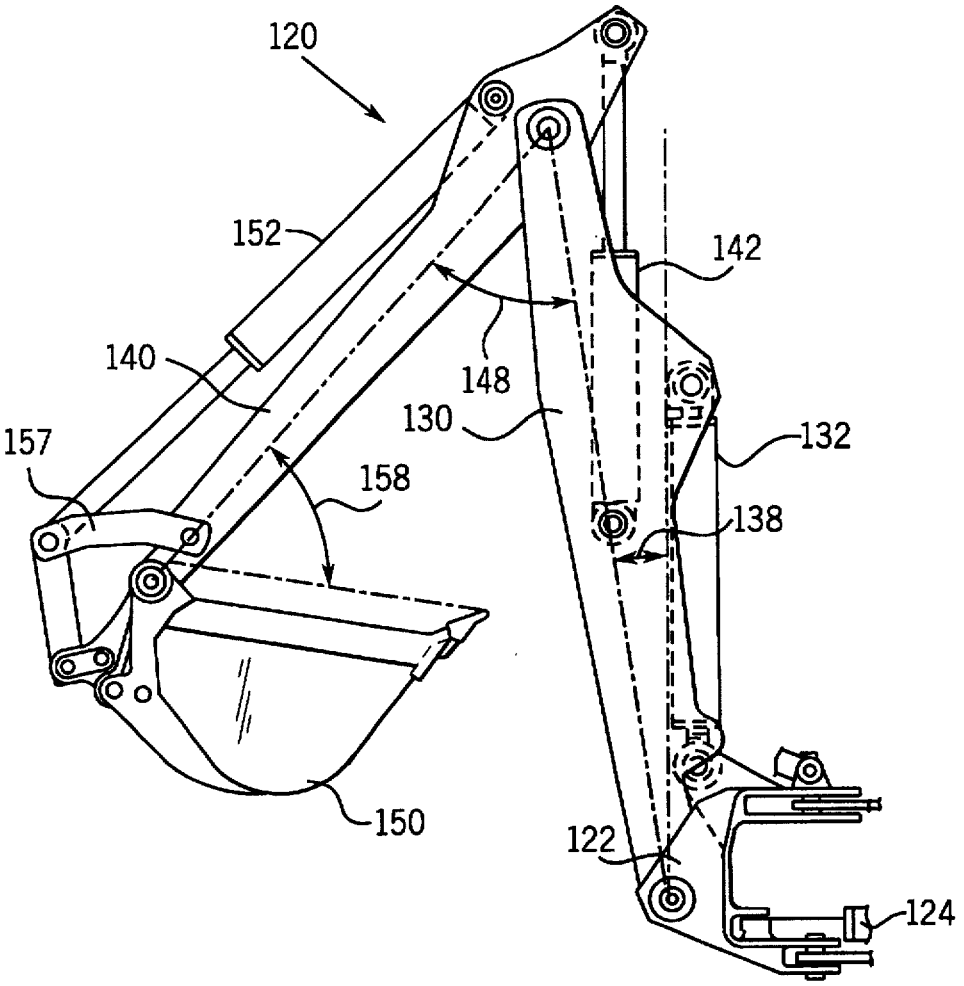
FIG. 2B is a side view of the backhoe assembly of FIG. 2A in a center position.
Figure 2C:
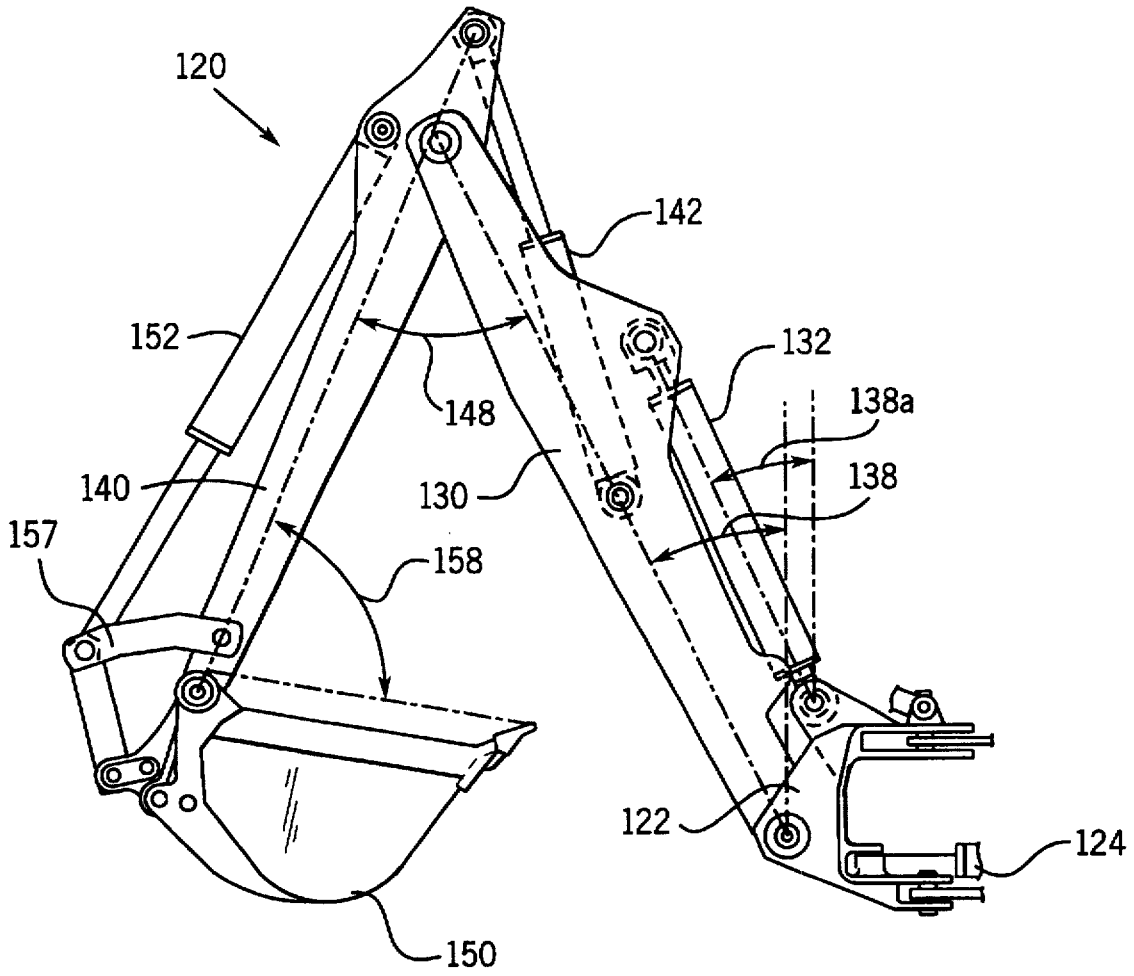
FIG. 2C is a side view of the backhoe assembly of FIG. 2A in a partially extended position.
Figure 2D:
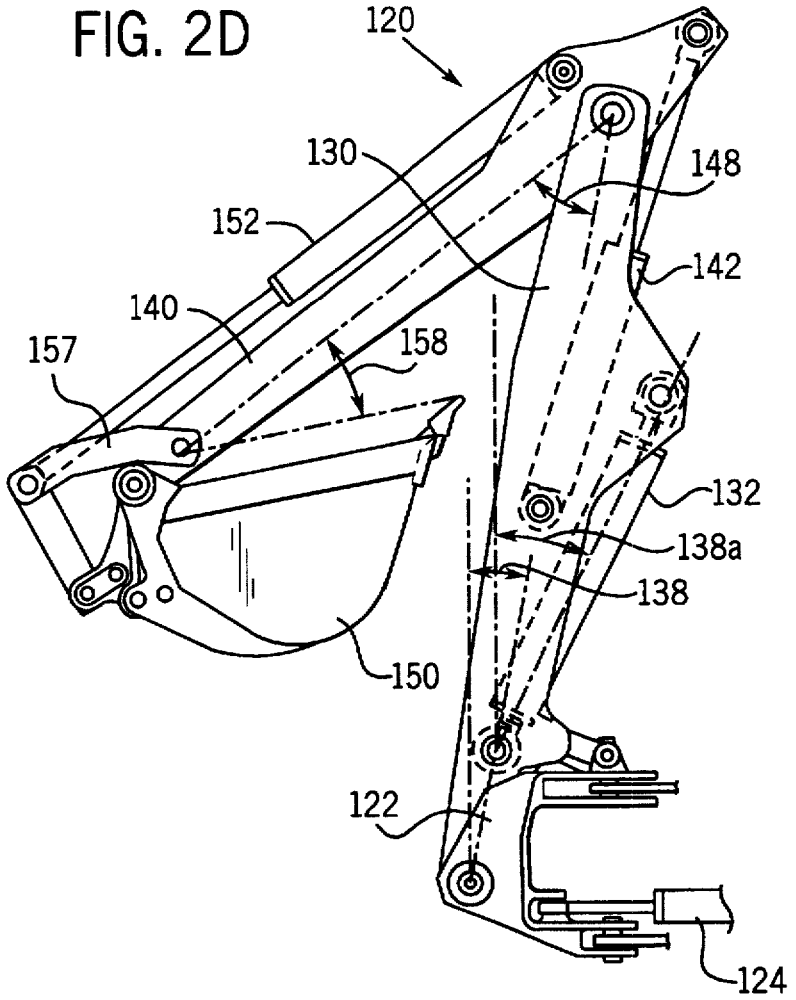
FIG. 2D is a side view of the backhoe assembly of FIG. 2A in a stored position.

In FIGS. 2B and 2C, boom 130 is shown in a partially extended angular position out and away from the base of work vehicle wherein hydraulic cylinder 132 is also oriented in a substantially but not completely identical angular position. In FIG. 2B, boom 130 is shown at a nearly but not completely vertical position wherein hydraulic cylinder 132 is oriented in a completely vertical transitional position "center" (this boom position will also be referred to as the "over-center" position or point). In FIG. 2D, boom 130 is shown stowed in the substantially retracted "over-center" (angular) position wherein hydraulic cylinder 132 is oriented in a substantially but not completely identical angular position.

According to an exemplary embodiment, hydraulic control valves 134, 144 and 154 (each a solenoid-operated three-position, four-way directional control valve) are each configured to provide three flow states: in a first (e.g. static) flow state shown in valve 144 in FIG. 2A, the flow of hydraulic fluid to hydraulic cylinder 142 is blocked; in a second (e.g. dynamic) flow state shown in valve 154 in FIG. 2A, the flow of hydraulic fluid is provided in a direction to extend a driving rod **152*a* within a sleeve 152*b* of hydraulic cylinder 152; in a third (e.g. dynamic) flow state shown in valve 134 in FIG. 2A, the flow of hydraulic fluid is provided in a direction to retract driving rod 132*a* within sleeve 132*b* of hydraulic cylinder 132. Each of valves 134, 144 and 154 includes a set of biasing elements 164*a*, 164*b* and 164*c*** (e.g. springs or the like, shown schematically) tending to maintain the static flow state unless the valve is directed to another state. Flow of the hydraulic fluid will follow a circuit according to the state of the control valves, e.g. from the reservoir to the pump through the valve to the hydraulic cylinder, which forces hydraulic fluid back through the valve and to the reservoir. Any hydraulic valve system known to provide suitable functionality and control can be used in alternative embodiments.

According to the preferred embodiment, each of control valves 134, 144 and 154 is electronically actuated by a control signal provided by a controller 170. During conventional operation of the backhoe assembly, an operator will manipulate a set of controls at a control panel 180 (in the cab of the work vehicle) to provide an input signal to controller 170. Based on the input signal, controller 170 will generate the control signals to actuate hydraulic control valves 134, 144 and 154 to effect a coordinated movement of backhoe assembly 120 to perform useful work as directed by the operator. As shown in FIG. 2A, a series of electrical control lines 171 couple control valves 134, 144 and 154 to controller 170; controller 170 provides appropriate control signals to the valve thereby actuating biasing elements 164*a*, 164*b* and 164*c* of each corresponding hydraulic cylinder 132, 142 and 152 to direct the valve to the proper flow state. Another set of control lines couple the operator's control panel 180 (which typically would include responsive indicator lights and various control levers) to controller 170. In alternative embodiments, any suitable control system or arrangement that will actuate the hydraulic cylinders of the respective segments of the backhoe assembly can be employed.

Shown schematically in FIG. 2A are sensors (shown as rotary potentiometers 136, 146 and 156) that provide signals (i.e. sensed values) indicative of the position of each segment of backhoe assembly 120. According to the preferred embodiment, sensors 136, 146 and 156 provide an electrical signal representative of the segment position for controller 170 through signal lines; boom sensor 136 provides a signal indicative of a boom angle 138 (e.g. the angular position of boom 130 with respect to the base of the vehicle); dipper sensor 146 provides a signal indicative of a dipper angle 148 (e.g. the angular position of dipper 140 with respect to boom 130); bucket sensor 156 provides a signal indicative of a bucket angle 158 (e.g. the angular position of bucket 150 with respect to dipper 140). Boom sensor signal representative of boom angle 138 can be transformed into a signal indicative of boom cylinder angle 138*a* by the control program, which includes the necessary geometric parameters to calculate the transformation, because the over-center determination is made with respect to the boom cylinder (not the boom). (For ease of reference, the term "over-center" is used to describe the boom position although in actuality the "center" position describes the orientation of the boom cylinder.)

According to a preferred embodiment, analog signals from sensors 136, 146 and 156 are converted to digital signals through an analog-to-digital converter at the interface with controller 170. In alternative embodiments, any of a wide variety of sensors or detectors known in the art (such as encoders or LVDTS, etc.) can be employed to provide a suitable signal indicative of the segment position to the controller. (In alternative embodiments, one or more sensors could be included to provide signals indicative of dynamic parameters such as velocity or acceleration of these segments; alternatively, a differential amplifier or like element can be used to provide a signal indicative of velocity based on the signal from the segment position sensors 136, 146 and 156.)

Controller 170 is configured to implement a control system for automating the storing of boom 130 (along with dipper 140 and bucket 150) in an over-center position. The control system can be in the form of a control program that is loaded or programmed into controller (which according to a particularly preferred embodiment comprises a programmable digital processor or microprocessor but according to alternative embodiments can comprise other devices programmable in either hardware or software or some suitable combination thereof). The control system according to any preferred embodiment will accept data input signals from the sensors 136, 146 and 156 and from control panel 180 and, based on the values of the data input signals in comparison with certain control criteria according to the control program, will provide an appropriate output control signal to control the hydraulic flow through the control valves to store the boom in the over-center position. The control criteria may be data values (typically loaded or stored in program memory of the controller) representative of geometric, dimensional, mass and dynamic properties of backhoe assembly 120, as well as other such parameters as would describe the system to allow stable control. The controller can be a stand-alone digital processor or preferably integrated can be with a microprocessor of the like used to monitor or control other vehicle systems and functions.

Figure 4A:
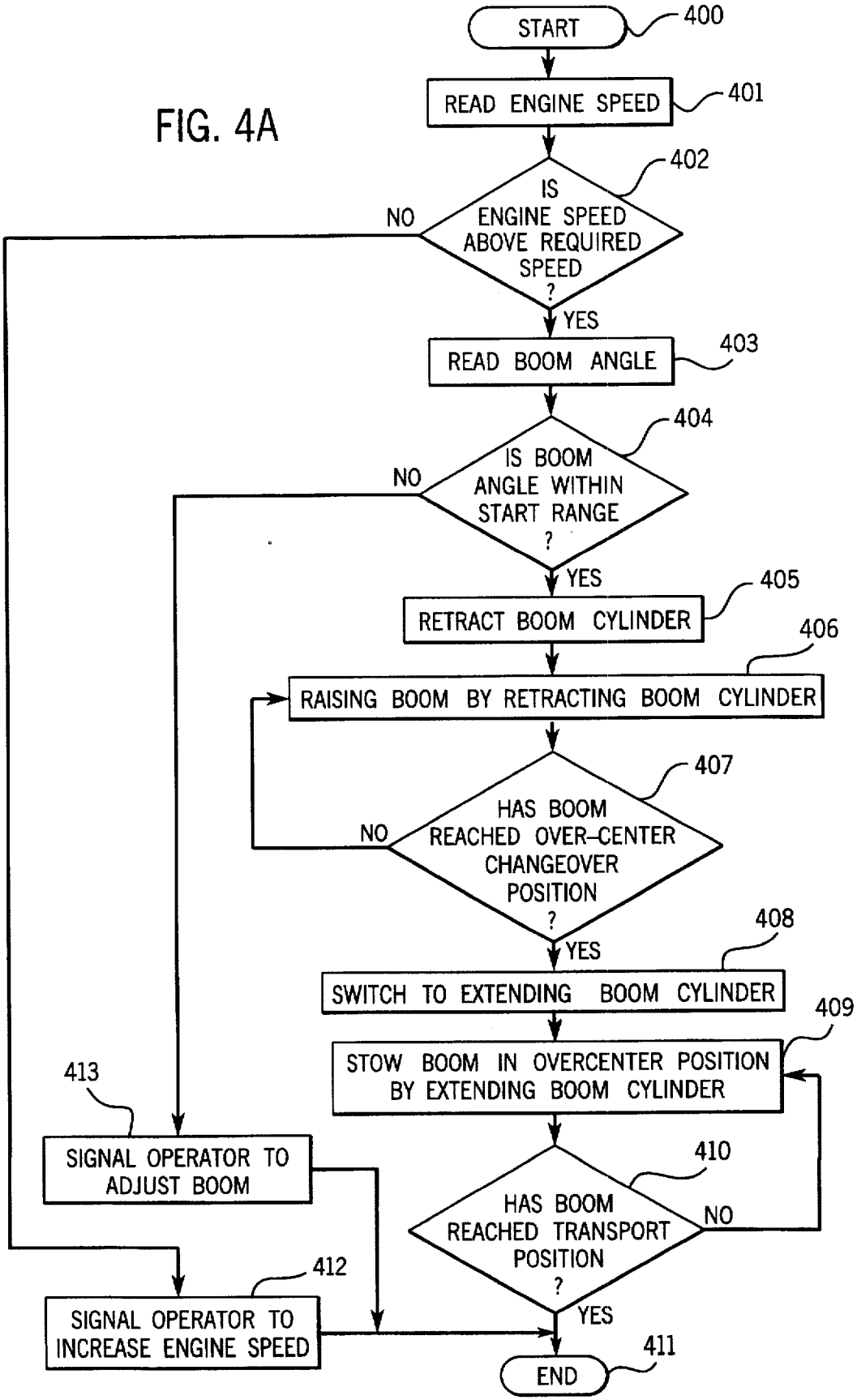
FIG. 4A and 4B are flow chart representations of a control system for automating the storing of the backhoe assembly according to a preferred embodiment of the present invention.
Figure 4B:
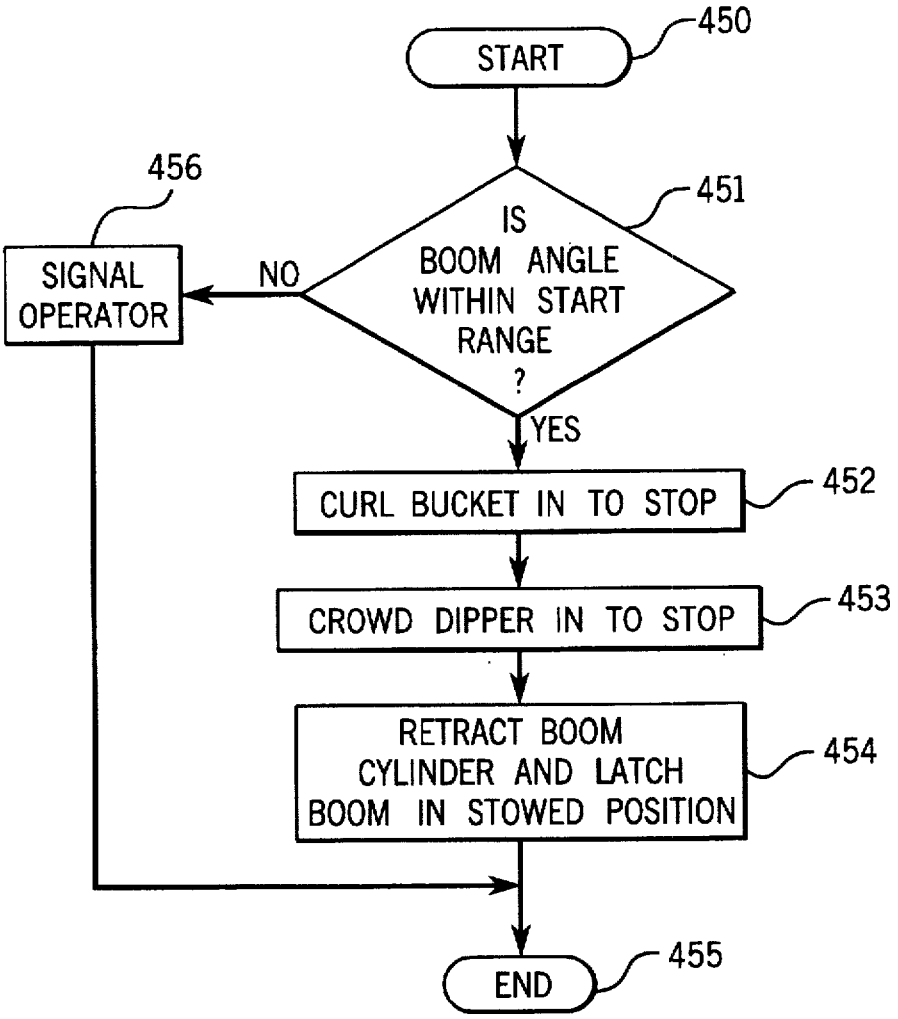

The process implemented in the control system for storing the boom in an over-center position according to a particularly preferred embodiment is illustrated in FIGS. 4A and 4B. As indicated, a certain level of operator interaction is relied upon in effecting the automated storing of the boom in the over-center position. Moreover, the operator initiates the automated storing process by providing a start command. At the start of the automated storing process, the boom may have been positioned out and away from the base of the work vehicle, but first is brought within relatively closer proximity to the base, for example as is shown in FIG. 2B. The operator initiates the over-center storing process from the control panel, typically after centering the boom on the swing tower; a switch can also be provided at the control panel so the operator can start the automated storing process or halt it at any point if the need arises.

At the outset of the automated storing process, the engine speed is detected (step 401) in connection with a device providing such input signals representative of operation of one or more vehicle systems to determine if the engine speed is above a required threshold speed (step 402) predetermined to be the minimum speed to develop a desired minimum flow rate is that will suitably operate the hydraulic system. (This threshold minimum engine speed to place hydraulic system in a ready state for the process may vary from one work vehicle to the next.) If the engine speed is too low, the operator is given an indication signal to increase the engine speed (step 412) and the storing process is aborted (i.e. ended) without any further effect (step 411). According to alternative embodiments, this step may be automated through the use of a control arrangement that is capable of adjusting the engine speed through the controller (or related systems).

If the engine speed is sufficient, the process continues and the boom angle 138 (i.e. position of the boom with respect to the base of the vehicle or some other stable reference point) is detected to determine if it is within a predetermined start range (step 404), i.e., typically in an extended position within a proximity somewhat close to the base of the vehicle. If the boom angle is not within the start range, the operator is given an indication signal to manually move the boom into the start range (step 413), i.e. a suitable proximity to the base of the vehicle. If the boom angle is within the start range, the automated storing process will continue as the hydraulic cylinder for the boom (i.e. boom cylinder) is retracted from the extended position (step 405) to raise the boom toward the base (step 406). If the boom angle was not within the start range, after the signal is provided to the operator (step 413), the process is aborted (i.e. ended) without any further action (step 411). The start range is predetermined to be within a range from which, among other things, sufficient momentum can be generated to drive the boom past the over-center position.

As the boom cylinder is retracted and the boom is raised, the boom angle is detected to determine whether it has reached a transition or over-center "changeover" point (step 407). At the over-center point, as is shown in FIG. 2B, further retraction of the boom cylinder will not bring the boom any closer to the base; a coordinated transition to extension of the boom cylinder is required to continue the movement of the boom toward the base. The process is devised to generate sufficient momentum while in retracting the boom cylinder to drive the boom past the transitional over-center point. If the boom has not yet been raised to the over-center changeover point, the boom cylinder is retracted further (e.g. step 405 is repeated) and monitoring of the boom angle continues (step 407). When the boom angle reaches the over-center changeover point (as detected), the requisite transition is directed by the control system to provide for the continued movement of the boom toward the base by switching from retracting to extending the boom cylinder (step 408). The boom is then smoothly driven past the over-center position and toward the base by further extension of the boom cylinder (step 409) until it is detected that the boom has reached the predetermined transport position (step 410), i.e. a predetermined boom angle, as is shown in FIG. 2D. The boom will generally have enough momentum as it reaches the transport position to actuate a mechanical latch which retains the boom in the transport position (see step 454 in FIG. 4B) by releasably clasping the boom to the swing tower structure. The process ends at this point (step 411).

According to a particularly preferred embodiment, the control system implemented in the controller also provides for the automated storing of the bucket and dipper in their respective transport positions (steps 451 through 453) in FIG. 4B. The storing of the backhoe assembly can further be automated in a process in which the bucket is curled and the dipper is crowded into their respective "fully in" positions (e.g. to their stops). These steps can be performed either prior to bringing the boom into the over-center transport position or while the boom is driven into the transport position.

According to a preferred embodiment of this aspect of the process, the position of the bucket and dipper (i.e. the bucket angle and dipper angle, respectively) are measured by sensors (e.g. rotary potentiometers 146 and 156) which provide signals representative of the bucket angle and dipper angle to the controller. As a result, the controller can determine when the bucket and dipper have reached their respective limits of travel (e.g. their respective transport positions). According to alternative embodiments, other arrangements (that do not necessarily require position sensors) can be employed. For example, the controller can instead be configured to actuate both the bucket and the dipper toward their respective stops for a determinable period of time which, based on the minimum hydraulic flow rate (based on the predetermined minimum engine speed), would be sufficient to have brought them into their respective stops. When the process for storing the bucket and the dipper is automated, it is desirable that the boom angle be within a predetermined range including a lower limit that ensures that the bucket will not be brought into contact with the ground as it is curled into its stop, the dipper is crowded into its stop, or the boom is driven to the over-center position. This particular minimum boom angle is determined by the particular geometry and dimensions of the backhoe assembly.

As shown in FIG. 4B, according to a preferred embodiment, this part of the storing process begins with the detection of the boom angle (step 451). If the boom angle is not within a predetermined start range for this part of the process, an indication signal to that effect is provided the operator (step 456) and the process is aborted (i.e. ended) without further action. This start range will be determined by the particular geometrical relationships of the boom, dipper and bucket of the vehicle, and may be different than the start range for storing the boom itself. If the boom is within the start range for this part of the storing process, the bucket will be curled into its predetermined stop position (step 452) and the dipper will be crowded into its predetermined stop position (step 453). (The bucket stop position and the dipper stop position may be determined by bucket sensor 156 and dipper sensor 146 or by other active detectors or passive elements such as a mechanical stop.) As is evident, according to alternative embodiments, this part of the storing process can take place either before, during or after the boom is stored in its over-center position. Coordinated movement of the boom, the dipper, and the bucket at this stage may provide sufficient momentum to latch the boom in the transport position (step 454). (Step 454 will not be necessary if the boom is already latched when the dipper is crowded and the bucket is curled into their respective stops.) The process ends at this point (step 455), preferably with the boom latched and the bucket and dipper at their respective stops.

In the implementation of any preferred embodiment of storing process, the boom will be manually brought to a central position on the swing tower by the operator before the automated storing process begins. In any preferred embodiment, the operator will generally have oversight and specifically will have responsibility for bringing the boom (and if necessary the rest of the backhoe assembly) close to the transport position before beginning the storing process to reduce the likelihood that any objects near the vehicle will be encountered during the automated storing process. Nevertheless, according to alternative embodiments, "full" automation could be effected wherein the boom angle and swing angle (as well as the bucket and dipper angles) are monitored and storing can be effected from a wider range of start positions (including those where the boom has been rotated about the swing tower under the control of two hydraulic swing cylinders).

Figure 3:
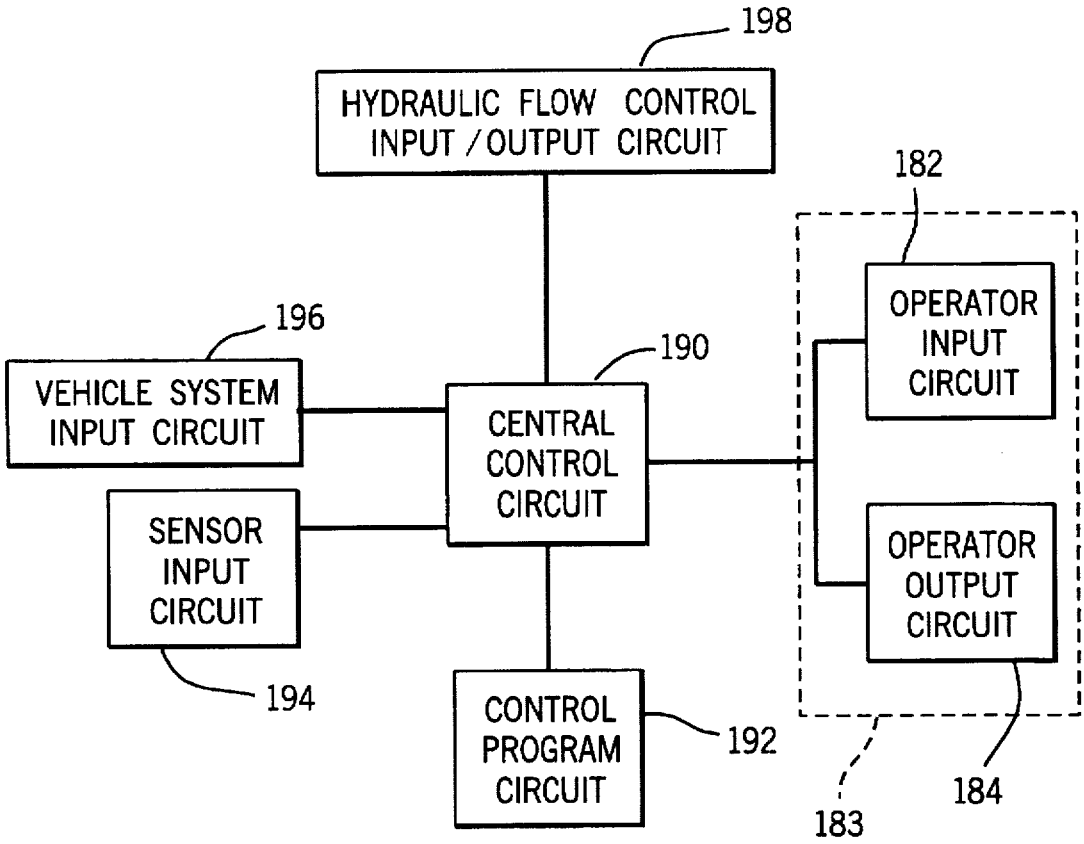
FIG. 3 is a block diagram of representative circuits and data flow for the control system of the backhoe assembly of the loader-backhoe according to a preferred embodiment of the present invention.

According to any preferred embodiment, controller 170 includes a programmable digital processor as its central control circuit 190 and also a control program circuit 192 (e.g. program memory or the like) as shown schematically in FIG. 3, in connection with other basic representative circuits including a sensor input circuit 194, a vehicle system input circuit 196 (which may also be combined with a vehicle system output circuit), a hydraulic flow control input/output circuit 198, an operator input circuit 182, and an operator output (or indicator) circuit 184 (to provide indications to the operator regarding the state of vehicle systems and processes). (According to an alternative embodiment, operator input circuit 182 and operator output circuit 184 can be integrated into an operator interface 183 contained in the control panel.) Each input circuit 194, 196, 198 and 182 provides suitable analog-to-digital conversion along with any necessary filtering and isolation to apply a digital signal of a suitable value range to central control circuit 190. (Each control output circuit will provide for suitable conversion of the output signal to a suitable value range.) Control program circuit 192 is programmed with a control program including the control function and control criteria to implement the control function based on the various system input signals (from input circuits 194, 196, 198 and 182) and based on parameters that define the physical system of the backhoe assembly. The parameters that define the physical system would include particular geometric values of the various segments (such as sensor locations and segment lengths) along with values (which may be determined or measured empirically or experimentally) that describe the inertial and dynamic effects (such as delays, hydraulic dynamics, mass properties, etc.). These parameters would ordinary be calibrated and adjusted for a particular work vehicle (or type of work vehicle) to prevent interferences or other error conditions or invalid values and programmed or stored as control criteria. In operation, after the operator has provided a "store" command to controller 170 through control panel 180, as the system input signals are applied to control program circuit 192, the control program provides for the automated boom storing process according to the sequence or method shown in FIGS. 4A through 4B.

As one of ordinary skill in the art who has reviewed this disclosure would understand, the various threshold, start and predetermined values and ranges and system parameters will vary from one work vehicle to the next. When the control scheme is implemented in a software program, such values and ranges can be conventionally programmed into the controller to achieve desired or suitable control during the automated stowing process. As also is evident, controller 170 may be configured to use dynamic signals (e.g. the velocity of boom 130) along with position input signals during the automated storing process (e.g. from the signal provided by sensor 136). Alternatively, the position of the boom cylinder could be directly monitored by a sensor to determine when it has reached the over-center position and to provide a signal representative thereof to the controller.

Although only a few exemplary embodiments of this invention have been described in detail above, those skilled in the art will readily appreciate that many modifications are possible in the exemplary embodiments without materially departing from the novel teachings and advantages of this invention. As is readily indicated, the invention can be employed with any of a variety of vehicles employing a boom (or like structure) that is appropriately stored in an over-center position. The method and apparatus of the present invention can be employed with a boom (or like implement) of any shape that includes an actuator that is driven over-center to store the boom. Moreover, the particular values of the signals and control program may vary within the spirit of the present invention from vehicle to vehicle depending on particular static and dynamic characteristics presented. The order of steps, for example, of storing the boom, crowding the dipper and curling the bucket, may also be varied or resequenced according to alternative embodiments of the invention. Accordingly, all such modifications are intended to be included within the scope of the invention as defined in the following claims. In the claims, each means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

What is claimed is:

1. An apparatus for storing a boom pivotally mounted to a vehicle, the apparatus comprising:

a boom actuator adapted to actuate the boom;

a boom sensor configured to provide a boom signal representative of the position of the boom actuator with respect to a stable reference point of the vehicle;

an actuator control assembly responsive to a control signal and adapted to manipulate the position of the boom by retracting or extending the boom cylinder; and a controller responsive to the boom signal and configured to provide the control signal to the actuator control assembly so the boom is automatically driven from an initial position extended at least partially away from the vehicle to a transport position in a relatively closer proximity to the vehicle by retracting the boom cylinder to drive the boom from the initial position to a transition position and then extending the boom cylinder to drive the boom from the transition position into the transport position.

2. The apparatus of claim 1 further comprising:

a dipper pivotally coupled to the boom and manipulable by a dipper actuator;

a pivotable bucket coupled to the dipper and manipulable by a bucket actuator;

a dipper sensor configured to provide a dipper signal representative of an angular position of the dipper with respect to the boom; and a bucket sensor configured to provide a bucket signal representative of a position of the bucket with respect to the dipper;

wherein the controller is configured to provide the control signal to the actuator control assembly so that the dipper actuator is actuated to drive the dipper into a stowed position and the bucket actuator is actuated to drive the bucket into a stowed position as the boom is driven into the transport position.

3. The apparatus of claim 1 wherein the boom sensor is a potentiometer.

4. The apparatus of claim 1 wherein the boom actuator is a double-acting hydraulic cylinder.

5. The apparatus of claim 1 wherein the controller includes a digital processor.

6. The apparatus of claim 5 wherein the controller includes a control program circuit configured to automatically drive the boom into the stored position in response to a command provided by an operator of the vehicle.

7. The apparatus of claim 1 wherein the boom actuator is a hydraulic cylinder.

8. The apparatus of claim 7 wherein the actuator control assembly includes a set of hydraulic flow control valves.

9. The apparatus of claim 8 wherein each of the set of hydraulic control valves is a three-position four-way directional control valve.

10. An apparatus for storing a boom activated by a hydraulic cylinder in an over-center position with respect to a base of work vehicle, comprising:

(a) means for detecting a boom signal indicative of a position of the boom;

(b) means for determining from the boom signal whether the position of the boom is within a predetermined start range;

(c) means for retracting the hydraulic cylinder to bring the boom toward the base of the work vehicle;

(d) means for determining from the first signal whether the boom has reached the over-center position; and (e) means for extending the hydraulic cylinder to bring the boom toward the base of the work vehicle when the boom has reached the over-center position.

11. The apparatus of claim 10 further comprising means for latching the boom in the transport position.

12. The apparatus of claim 10 further comprising means for crowding a dipper pivotally mounted to the boom into a stored position.

13. The apparatus of claim 12 further comprising means for crowding a bucket pivotally mounted to the dipper into a stored position.

14. The apparatus of claim 13 further comprising:

means for detecting a dipper signal indicative of a position of the dipper;

means for detecting a bucket signal indicative of a position of the dipper;

means for stopping the dipper after it has been crowded into a predetermined stop position;

means for stopping the bucket after it has been curled into a predetermined stop position.

15. A method of storing a boom activated by a hydraulic cylinder in an over-center position with respect to a base of a work vehicle, the method comprising the steps of:

(a) detecting a boom signal indicative of a position of the boom;

(b) determining from the boom signal whether the position of the boom is within a start range;

(c) retracting the hydraulic cylinder to bring the boom toward the base of the work vehicle;

(d) determining from the boom signal whether the boom has reached the over-center position; and (e) extending the hydraulic cylinder to bring the boom toward the base of the work vehicle when the boom has reached the over-center position.

16. The method of claim 15 further comprising the steps of detecting an engine speed of an engine of the vehicle;

providing an indication to an operator of the vehicle if the engine speed is below a predetermined threshold speed.

17. the method of claim 15 further comprising latching the boom in the transport position.

18. The method of claim 15 further comprising the step of crowding a dipper pivotally mounted to the boom into a stored position.

19. The method of claim 18 further comprising the step of crowding a bucket pivotally mounted to the dipper into a stored position.

20. The method of claim 19 further comprising the steps of:

detecting a dipper signal indicative of a position of the dipper;

detecting a bucket signal indicative of a position of the dipper;

stopping the dipper after it has been crowded into a predetermined stop position;

stopping the bucket after it has been curled into a predetermined stop position.

* * * * *

UNITED STATES PATENT AND TRADEMARK OFFICE

CERTIFICATE OF CORRECTION

PATENT NO. : 5,748,097

DATED : May 5, 1998

INVENTOR(S) : Collins, David L.

It is certified that error appears in the above-identified patent and that said Letters Patent is hereby corrected as shown below:

In the specification, at column 1, line 14, after "tractors", please delete the comma.

In the specification, at column 1, line 48, please change "my" to --any--.

In the specification, at column 3, line 5, please change "FIG." to --FIGS.--.

In the specification, at column 3, line 19, after "mounted on", please insert -- the--.

In the specification, at column 3, line 20, please delete " 104".

In the specification, at column 4, line 12, after "at", please insert -- a--.

In the specification, at column 4, line 18, after "130 is actuated by", please insert -- a--.

In the specification, at column 4, line 26, please change "2a)" to --2A) and--.

In the specification, at column 4, line 31, after "base of", please insert -- the--.

In the specification, at column 4, lines 36-37, please change "position "center"" to --"center" position--.

In the specification, at column 5, line 12, please change "valve" to --valves--.

In the specification, at column 5, line 14, please change "valve" to --valves--.

In the specification, at column 5, line 14, please change "state" to --states--.

In the specification, at column 5, line 26, after "156", please insert -- each--.

UNITED STATES PATENT AND TRADEMARK OFFICE

CERTIFICATE OF CORRECTION

PATENT NO. : 5,748,097

DATED : May 5, 1998

INVENTOR(S) : Collins, David L.

It is certified that error appears in the above-identified patent and that said Letters Patent is hereby corrected as shown below:

In the specification, at column 5, line 26, please change "provide" to --provides--.

In the specification, at column 5, line 35, please change "Boom" to --The boom--.

In the specification, at column 5, line 63, after "into", please insert -- the--.

In the specification, at column 6, line 6, please delete " an".

In the specification, at column 6, line 7, please change "signal" to --signals--.

In the specification, at column 6, line 15, please change "integrated can be" to --can be integrated--.

In the specification, at column 6, line 15, please change "of" to --or--.

In the specification, at column 6, line 39, please delete " is".

In the specification, at column 6, line 40, after "place", please insert -- the--.

In the specification, at column 6, line 54, after "i.e.", please delete the comma.

In the specification, at column 7, line 11, please delete " in".

In the specification, at column 7, line 15, please change "405" to --406--.

In the specification, at column 7, line 27, please change "which" to --that--.

In the specification, at column 7, line 45, please change "which" to --that--.

In the specification, at column 7, line 54, please change "which" to --that--.

In the specification, at column 8, line 3, after "provided", please insert -- to--.

UNITED STATES PATENT AND TRADEMARK OFFICE

CERTIFICATE OF CORRECTION

PATENT NO. : 5,748,097

DATED : May 5, 1998

INVENTOR(S) : Collins, David L.

It is certified that error appears in the above-identified patent and that said Letters Patent is hereby corrected as shown below:

In the specification, at column 8, line 27, after "embodiment of", please insert -- the--.

In the specification, at column 9, line 8, please change "ordinary" to --ordinarily--.

In the specification, at column 9, line 16, please change "through" to --and--.

In the claims, at column 10, line 3, please change "cylinder" to --actuator--.

In the claims, at column 10, lines 9-10, please change "cylinder" to --actuator--.

In the claims, at column 10, lines 11-12, please change "cylinder" to --actuator--.

In the claims, at column 10, line 39, please change "stored" to --transport--.

In the claims, at column 10, line 50, after "base of", please insert -- a--.

In the claims, at column 10, line 58, please change "first" to --boom--.

In the claims, at column 10, line 64, please change "in the" to --in a--.

In the claims, at column 11, line 2, please change "crowding" to --curling--.

In the claims, at column 11, line 8, please change "dipper" to --bucket--.

In the claims, at column 11, line 10, after "position;", please insert -- and--.

In the claims, at column 12, line 3, after "of the", please insert -- work--.

In the claims, at column 12, line 4, after "of the", please insert -- work--.

In the claims, at column 12, line 6, after "comprising", please insert -- the step of--.

UNITED STATES PATENT AND TRADEMARK OFFICE

CERTIFICATE OF CORRECTION

PATENT NO. : 5,748,097

DATED : May 5, 1998

INVENTOR(S) : Collins, David L.

It is certified that error appears in the above-identified patent and that said Letters Patent is hereby corrected as shown below:

In the claims, at column 12, line 7, please change "in the" to --in a--.

In the claims, at column 12, line 12, please change "crowding" to --curling--.

In the claims, at column 12, line 21, please change "dipper" to --bucket--.

In the claims, at column 12, line 23, after "position;", please insert -- and--.

In the abstract, please change the lines (lines 9-10) reading "the boom signal and to provide the control signal to the" to read --the boom signal to provide the control signal to the--.

Signed and Sealed this

Third Day of November, 1998

*Attest:*

*Attesting Officer*

Bruce Lehman

BRUCE LEHMAN

*Commissioner of Patents and Trademarks*